US005269278A

United States Patent [19]

Heinemann et al.

[11] Patent Number: 5,269,278

[45] Date of Patent: Dec. 14, 1993

[54] DEVICE FOR STORING AND FEEDING FUEL VAPORS

[75] Inventors: Joachim Heinemann, Weinheim; Reinhard Tinz, Gross-Biberau, both of Fed. Rep. of Germany

[73] Assignee: Firma Carl Freudenberg, Weinheim, Fed. Rep. of Germany

[21] Appl. No.: 984,162

[22] Filed: Dec. 2, 1992

[30] Foreign Application Priority Data

Dec. 4, 1991 [DE] Fed. Rep. of Germany ..... 4139946

[51] Int. Cl.[5] ..... F02M 25/08; F02M 33/02

[52] U.S. Cl. ..... 123/520

[58] Field of Search ..... 123/383, 516, 518, 519, 123/520, 521; 137/599, 883

[56] References Cited

U.S. PATENT DOCUMENTS

| | | | |
|---|---|---|---|
| 4,541,396 | 9/1985 | Sato et al. | 123/520 |
| 4,703,737 | 11/1987 | Cook et al. | 123/520 |
| 4,763,634 | 8/1988 | Morozumi | 123/520 |
| 5,005,550 | 4/1991 | Bugin, Jr. et al. | 123/520 |
| 5,060,621 | 10/1991 | Cook et al. | 123/520 |
| 5,069,188 | 12/1991 | Cook | 123/520 |
| 5,083,546 | 1/1992 | Detweiler et al. | 123/520 |
| 5,103,794 | 4/1992 | Shiraishi | 123/520 |
| 5,183,022 | 2/1993 | Cook | 123/520 |
| 5,183,023 | 2/1993 | Hanson | 123/520 |
| 5,190,015 | 3/1993 | Nakata et al. | 123/520 |

FOREIGN PATENT DOCUMENTS 3909887 9/1990 Fed. Rep. of Germany .

*Primary Examiner*—E. Rollins Cross
*Assistant Examiner*—Thomas Moulis
*Attorney, Agent, or Firm*—Kenyon & Kenyon

[57] ABSTRACT

A device for the temporary storing and dosed feeding of volatile fuel constituents found in a free space of a tank installation into an intake manifold of an internal combustion engine capable of being charged by a supercharger, comprising a venting line connecting the free space to a storage chamber containing an absorption element, at least one line connecting the storage chamber to the intake manifold, a valve having at least one inlet port, at least two outlet ports, a main valve seat, and an auxiliary valve seat, a first non-return valve allocated to a first outlet port of the at least two outlet ports, and a second non-return valve allocated to a second outlet port of the at least two outlet ports, wherein the first outlet port of the at least two outlet ports communicates with the intake manifold, and the second outlet port of the at least two outlet ports communicates with a low-pressure area of the supercharger.

19 Claims, 2 Drawing Sheets

DEVICE FOR STORING AND FEEDING FUEL VAPORS

BACKGROUND OF THE INVENTION

The invention relates generally to devices for the temporary storing and dosed feeding of volatile fuel constituents found in the free space of a tank installation into the intake manifold of an internal combustion engine. The invention relates more particularly to a device comprising a venting line which connects the free space of the fuel tank to a storage chamber containing an absorption element, and at least one line, capable of being closed by an electromagnetically actuated valve, which connects the storage chamber to the intake manifold.

German Published Patent Application DE OS 39 09 887 describes a process for testing the ability of a tank venting valve to be triggered. This tank venting valve allows air containing fuel vapors to be supplied to the intake area of an internal combustion engine.

The device and, more particularly, the valve described in DE OS 39 09 887 cannot be used when the internal combustion engine is charged by a supercharger. Because different pressures exist in the intake manifold depending upon the particular load states of the engine, that device cannot operate properly over the entire load range.

SUMMARY OF THE INVENTION

An object of the invention is to provide a venting and feeding device that can be used in conjunction with loaded internal combustion engines. In particular, an object of the invention is to provide a device of this type which can be used in conjunction with a supercharger, which will be understood by one skilled in the art to be a compressor, which can be, for example, an exhaust turbocharger, a mechanically driven supercharger, or a Roots blower. A further object of the invention is to provide a device of this type which can be produced simply and cost-effectively with compact dimensions, few component parts, and good working properties over a long service life.

These objectives are solved according to the invention by providing a device for the temporary storing and dosed feeding of volatile fuel constituents found in a free space of a tank installation into an intake manifold of an internal combustion engine capable of being charged by a supercharger, comprising a venting line connecting the free space to a storage chamber containing an absorption element, at least one line connecting the storage chamber to the intake manifold, a valve having at least one inlet port, at least two outlet ports, a main valve seat, and an auxiliary valve seat, a first non-return valve allocated to a first outlet port of the at least two outlet ports, and a second non-return valve allocated to a second outlet port of the at least two outlet ports, wherein the first outlet port of the at least two outlet ports communicates with the intake manifold, and the second outlet port of the at least two outlet ports communicates with a low-pressure area of the supercharger. The passage through the main valve seat can be restricted by an electrically actuated driving mechanism, and the passage through the auxiliary valve seat can be restricted by a vacuum advance mechanism using an adjustable membrane and a compression spring.

The construction of the device according to the invention is very simple, and costly switching devices, which could interfere with the reliable operation of the device, are not needed. Moreover, a distinguishing feature of the device is that there are few subassemblies to connect together, and the transition from intake operation to supercharger operation follows automatically. The particular membrane selection results in an excellent fine dosing in the near idling range during intake operation. The refinement of the valve, whereby the first outlet communicates only with the intake manifold in the direction of flow behind the throttle valve, and the second outlet communicates only with the low-pressure area of the supercharger, results in good working properties for the device.

DETAILED DESCRIPTION

Figure 1:
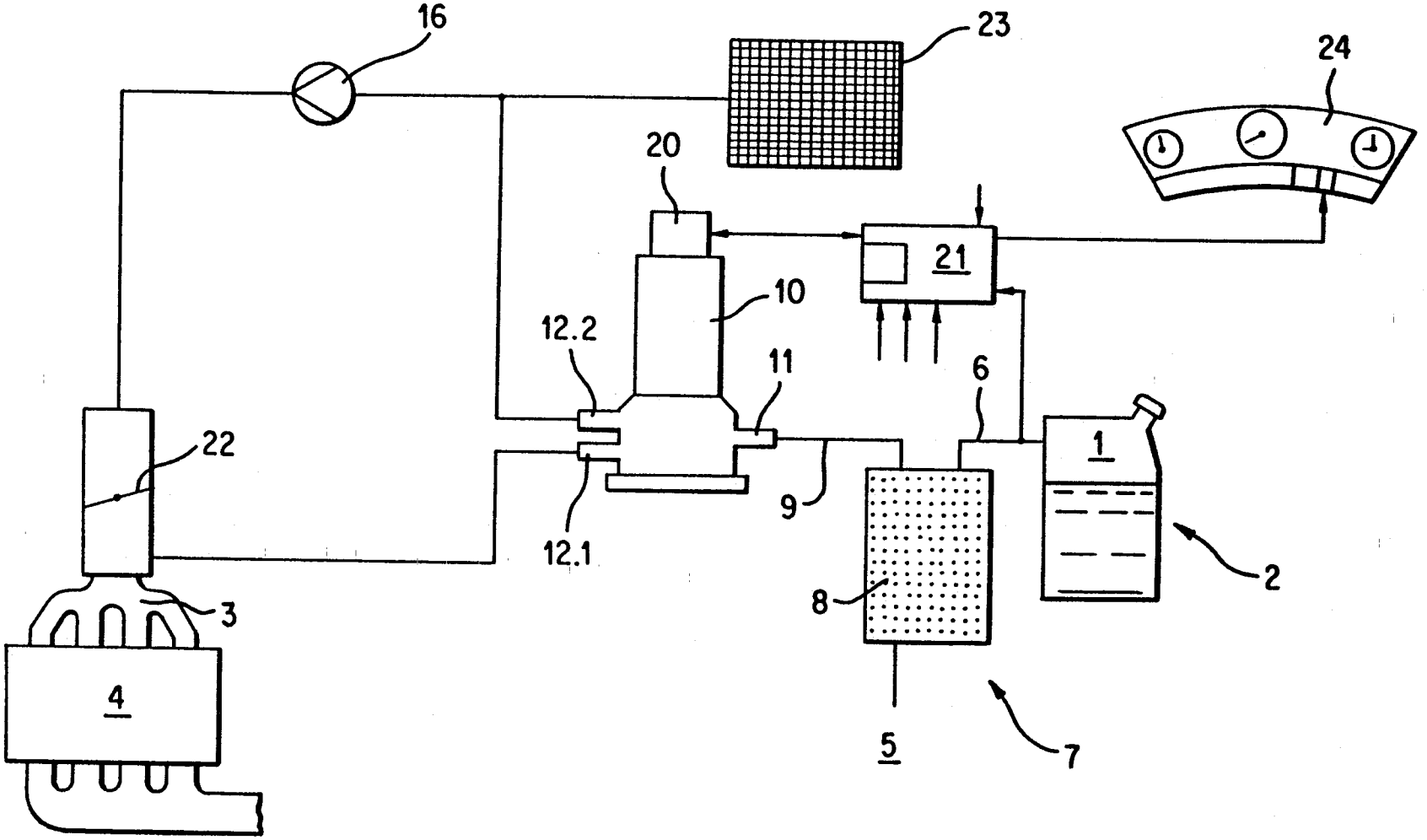
FIG. 1 shows a schematic diagram of a storing and feeding device according to the invention.

The device depicted in FIG. 1 comprises an internal combustion engine 4, which is charged by a supercharger 16, whereby a throttle valve 22, which is enlarged in the illustration, is arranged at an intake manifold 3. Air supplied to the internal combustion engine 4 is first conducted through an air filter 23.

A venting line 6 communicates with a free space 1 in a fuel tank 2. Venting line 6 allows volatile fuel constituents to travel into an absorption element 8 arranged in a storage chamber 7. The storage chamber may allow air to be drawn in from the atmosphere 5. The volatile fuel constituents from the free space 1 and the absorption element 8 arrive via line 9 in a valve 10.

FIG. 1 depicts the valve 10 only schematically, showing its outer outlines. It has two outlet ports 12.1, 12.2 and one inlet port 11, which is connected to the line 9. One of the outlet ports 12.1 is connected to the intake manifold 3, and the other outlet port 12.2 is connected to the low-pressure area of the supercharger 16.

Figure 2:
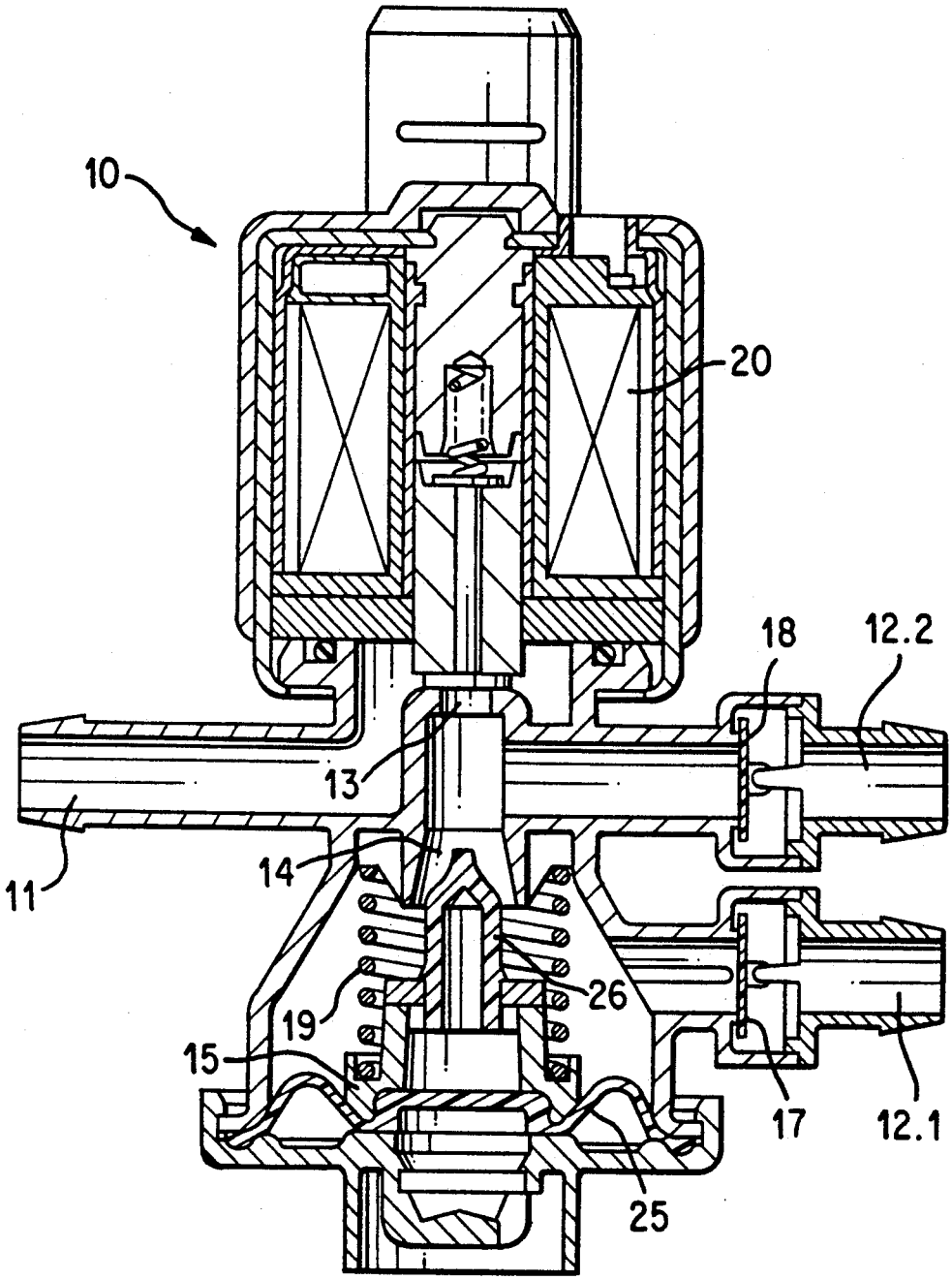
FIG. 2 shows an embodiment of a valve constructed according to the invention, which can be applied in the device depicted in FIG. 1.

As shown in the enlarged cross-sectional view of the valve 10 in FIG. 2, a first non-return valve 17, which is able to be traversed by flow only in the direction of the intake manifold 3, is located in outlet port 12.1, and a second non-return valve 18, which is able to be traversed by flow only in the direction of the supercharger 16, is located in outlet port 12.2. The non-return valves may be of a particularly simple construction and designed to be loaded with resilient spring tension and actuated by differential pressure. The non-return valves 17, 18 in this exemplified embodiment consist of elastically deformable tongue valves. In place of these valves, commercially available spring-loaded ball non-return valves can be used, for example. The non-return valves, when not actuated by differential pressure, seal off the outlet ports under elastic prestressing. This aspect of the invention makes it possible to dispense with an external switching of the non-return valves.

As depicted in FIG. 1, a diagnostic unit 21 and an indicating device 24 serve to monitor and control the device according to the invention. The diagnostic unit 21 has signal input and signal output, which monitor the storing and feeding device to check for proper functioning. The diagnostic unit 21 can constitute, for example, a component of an engine characteristics map for an engine control system. The input data can consist, for example, of characteristic values, which would be available anyway for an applied electronic engine management. For example, the input signals may indicate the position of the throttle valve, the speed of the internal combustion engine, different temperatures and pressures inside and outside of the internal combustion engine, and the exhaust gas composition. Other input and output variables are likewise conceivable.

The indicating device 24 is connected to the diagnostic unit 21 to monitor the feeding and storing device. The indicating device 24 may be, for example, control instruments, which can be integrated in the dashboard. Irregularities within the storing and feeding device are displayed on the indicating device 24, or indicated by any appropriate visual and/or audio signals, when an established threshold value defining the tolerance between actual value and setpoint value is exceeded.

The diagnostic unit 21 controls an electrically actuated driving mechanism 20 in the valve 10. The driving mechanism 20 is provided with electrical terminal connections, and the terminal connections communicate via signal conduction with the diagnostic unit 21. As shown in FIG. 2, driving mechanism 20 controls the passage of volatile fuel constituents through a main valve seat 13 in the valve 10. Thus, in dependence upon parameters input into the diagnostic unit 21, the driving mechanism 20 accordingly governs the orifice cross-section of the main valve seat 13, and, therefore, the volumetric flow of volatile fuel constituents into the intake manifold 3.

In addition to the main valve, the valve 10 also has an auxiliary valve which consists of a vacuum advance mechanism 15 controlling the flow through an auxiliary valve seat 14. The auxiliary valve is actuated by differential pressure. The vacuum advance mechanism 15 has a supporting collar, which abuts on one side an adjustable membrane 25 and, on the other side, a compression spring 19. The adjustable membrane 25 depicted in FIG. 2 has a rolling-diaphragm-type form, a shape which limits stresses within the membrane. The resiliency of the compression spring 19 can be selected in accordance with the particular engine and tank installation to which it is to be applied, thus allowing valves of essentially the same construction to be applied in a variety of circumstances by merely selecting different springs. The auxiliary valve seat 14 may have a conical design and, if necessary, can be engaged by a conically designed sealing member 26 of elastomeric material. Advantages of an auxiliary valve constructed in the above manner are improved working properties over a long service life and the ability to control more precisely the flow of volatile fuel constituents.

The valve of the present invention allows passage of the volatile fuel constituents to occur to the appropriate areas at the appropriate times. In intake operation, the volatile fuel constituents flow from the absorption element 8 into the valve 10 and through the first outlet port 12.1 by suction from the vacuum into the intake manifold 3 of the internal combustion engine 4. In supercharger operation under partial load or full load, when the maximum possible injection of volatile fuel constituents out of the absorption element 8 into the internal combustion engine 4 is needed, and excess pressure is applied in the intake duct, the first non-return valve 17 of the first outlet port 12.1 closes automatically because of the pressure difference, thus reliably avoiding a bypass of the supercharger 16 through the valve 10. The non-return valve 18 of the second outlet port 12.2 is open at this stage, and the volatile fuel constituents move through the second outlet port 12.2 toward the supercharger 16. The volatile fuel constituents, in the same way as the fuel-air mixture, are then delivered with excess pressure by the supercharger 16 into the combustion chambers of the internal combustion engine 4.

During idle operation of the internal combustion engine, the auxiliary valve seat is completely or almost completely sealed by the vacuum advance mechanism, in order to limit the flow of volatile fuel constituents into the area between the throttle valve and the internal combustion engine. During intake operation under partial load, the vacuum advance mechanism controls the feeding of volatile fuel constituents into the intake manifold, whereby the vacuum advance mechanism is capable of being actuated by a differential pressure prevailing between the atmosphere and the inside of the valve.

In the embodiment described, it is a particular advantage that the first outlet port 12.1 is arranged downstream from the auxiliary valve seat 14 and that the second outlet port 12.2 is arranged downstream from only the main valve seat 13. This allows greater quantities of volatile fuel constituents to be collected from the absorption element 8 during supercharger operation by travelling directly through the main valve seat 13 to the second outlet port 12.2, without having to travel through the auxiliary valve. Thus, improved feeding is achieved by circumventing the vacuum advance mechanism, since fewer restricting points are present.

What is claimed is:

1. A device for storing and feeding volatile fuel constituents from a free space of a tank installation into an intake manifold of an internal combustion engine capable of being charged by a supercharger, comprising:

a venting line connecting the free space to a storage chamber containing an absorption element;

at least one line connecting the storage chamber to the intake manifold;

a valve having at least one inlet port, at least two outlet ports, a main valve seat, and an auxiliary valve seat;

a first non-return valve allocated to a first outlet port of said at least two outlet ports; and a second non-return valve allocated to a second outlet port of said at least two outlet ports;

wherein the first outlet port of said at least two outlet ports communicates with the intake manifold, and the second outlet port of said at least two outlet ports communicates with a low-pressure area of the supercharger.

2. The device according to claim 1, wherein the first outlet port is arranged downstream from the auxiliary valve seat, and the second outlet port is arranged downstream from the main valve seat.

3. The device according to claim 1, wherein passage through the auxiliary valve seat is able to be restricted by means of a vacuum advance mechanism capable of being actuated by a differential pressure.

4. The device according to claim 3, wherein the vacuum advance mechanism comprises a supporting collar, which abuts on one side an adjustable membrane and, on the other side, a compression spring.

5. The device according to claim 3, wherein the vacuum advance mechanism is comprised of an elastomeric material.

6. The device according to claim 2, wherein passage through the auxiliary valve seat is able to be restricted by means of a vacuum advance mechanism comprised of an elastomeric material and capable of being actuated by a differential pressure, wherein the vacuum advance mechanism has a supporting collar, which abuts on one side an adjustable membrane and, on the other side, a compression spring.

7. The device according to claim 1, wherein the first and second non-return valves are designed to be loaded with resilient tension and actuated by differential pressure.

8. The device according to claim 7, wherein when not actuated by differential pressure, the first non-return valve is forced to engage with a first sealing seat arranged in the first outlet port to seal off the first outlet port, and the second non-return valves is forced to engage with a second sealing seat arranged in the second outlet port to seal off the second outlet port.

9. The device according to claim 2, wherein the first and second non-return valves are designed to be loaded with resilient tension and actuated by differential pressure and, when not actuated by differential pressure, the first non-return valve is forced to engage with a first sealing seat arranged in the first outlet port to seal off the first outlet port, and the second non-return valves is forced to engage with a second sealing seat arranged in the second outlet port to seal off the second outlet port.

10. The device according to claim 1, further comprising an electrically actuated driving mechanism for restricting flow through the main valve seat.

11. The device according to claim 10, wherein the electrically actuated driving mechanism comprises electrical terminal connections which communicate with a diagnostic unit.

12. The device according to claim 2, further comprising an electrically actuated driving mechanism for restricting flow through the main valve seat, wherein the electrically actuated driving mechanism comprises electrical terminal connections which communicate with a diagnostic unit.

13. A valve for use in a device for storing and feeding volatile fuel constituents from a free space of a tank installation into an intake manifold of an internal combustion engine capable of being charged by a supercharger, comprising:

at least one inlet port;

at least two outlet ports;

a main valve seat;

an auxiliary valve seat;

a first non-return valve allocated to a first outlet port of said at least two outlet ports;

a second non-return valve allocated to a second outlet port of said at least two outlet ports;

wherein the first outlet port of said at least two outlet ports is designed to communicate with the intake manifold, and the second outlet port of said at least two outlet ports is designed to communicate with a low-pressure area of the supercharger; and wherein the first outlet port is arranged downstream from the auxiliary valve seat, and the second outlet port is arranged downstream from the main valve seat.

14. The valve according to claim 13, wherein the auxiliary valve seat is able to be sealed by means of a vacuum advance mechanism capable of being actuated by a differential pressure.

15. The valve according to claim 14, wherein the vacuum advance mechanism has a supporting collar, which abuts on one side an adjustable membrane and, on the other side, a compression spring.

16. The valve according to claim 13, wherein the first and second non-return valves are designed to be loaded with spring tension and actuated by differential pressure.

17. The valve according to claim 13, wherein the first and second non-return valves are designed to be loaded with spring tension and actuated by differential pressure.

18. The valve according to claim 13, further comprising an electrically actuated driving mechanism for restricting flow through the main valve seat.

19. The valve according to claim 18, wherein the electrically actuated driving mechanism comprises electrical terminal connections which communicate with a diagnostic unit.

* * * * *

UNITED STATES PATENT AND TRADEMARK OFFICE

CERTIFICATE OF CORRECTION

PATENT NO. : 5,269,278
DATED : Dec. 14, 1993
INVENTOR(S) : HEINEMANN et al.

It is certified that error appears in the above-indentified patent and that said Letters Patent is hereby corrected as shown below:

Column 6, line 28, "claim 13" should be --claim 14--.

Signed and Sealed this

Thirteenth Day of June, 1995

Bruce Lehman

*Attest:*

BRUCE LEHMAN

*Attesting Officer*

*Commissioner of Patents and Trademarks*